US005437562A

United States Patent [19]

Michael

[11] Patent Number: 5,437,562

[45] Date of Patent: Aug. 1, 1995

[54] LOW PROFILE EDGE MOUNT CONNECTOR

[75] Inventor: George W. Michael, Harrisburg, Pa.

[73] Assignee: The Whitaker Corporation, Wilmington, Del.

[21] Appl. No.: 159,180

[22] Filed: Nov. 30, 1993

Related U.S. Application Data

[63] Continuation-in-part of Ser. No. 38,739, Mar. 26, 1993.

[51] Int. Cl.[6] ..... H01R 9/05

[52] U.S. Cl. ..... 439/581; 439/63

[58] Field of Search ..... 439/578–585, 439/675, 63, 98, 99; 333/260, 261

[56] References Cited

U.S. PATENT DOCUMENTS

| | | | |
|---|---|---|---|
| 3,910,665 | 10/1975 | Stull | 339/17 C |
| 3,915,535 | 10/1975 | O'Keefe et al. | 339/17 C |
| 4,138,179 | 2/1979 | Miller et al. | 339/17 LC |
| 4,656,441 | 4/1987 | Takahashi et al. | 333/33 |
| 4,737,111 | 4/1988 | Minar et al. | 439/63 |
| 4,741,703 | 3/1988 | Johnescu et al. | 439/63 |
| 4,801,269 | 1/1989 | Howard et al. | 439/63 |
| 4,975,066 | 12/1990 | Sucheski et al. | 439/63 |
| 4,996,478 | 2/1991 | Pope | 439/581 |
| 5,013,261 | 5/1991 | Seisz et al. | 439/581 |
| 5,112,249 | 5/1992 | Henry et al. | 439/581 |
| 5,190,461 | 3/1993 | Oorui et al. | 439/63 |
| 5,211,581 | 5/1993 | Schwartz et al. | 439/581 |

*Primary Examiner*—David L. Pirlot
*Attorney, Agent, or Firm*—William B. Noll

[57] ABSTRACT

This invention is directed to a low profile coaxial cable connector assembly for edge mounting to a planar electronic device, such as a printed circuit board, where electrical circuitry is provided thereon for electrically interconnecting to the assembly. The assembly comprises a dielectric housing having at one end thereof a pair of spaced-apart, parallel walls adapted to straddle and be secured to the planar electronic device, and at the opposite end thereof a cavity for the reception of an electrically terminated coaxial cable. Within the other end a grounding contact clip is provided having a pair of parallelly extending spring metal arms for receiving the terminated coaxial cable, and a signal contact for mating with the terminated coaxial cable. The grounding clip and signal contact further include extensions therefrom for electrically interconnecting to said planar electronic device, where the extensions are exposed between the spaced-apart walls and may be soldered to complementary traces or pads on the surfaces of the planar electronic device.

8 Claims, 7 Drawing Sheets

LOW PROFILE EDGE MOUNT CONNECTOR

RELATED APPLICATION

This application is a continuation-in-part of co-pending application, U.S. Ser. No. 08/038,739, filed Mar. 26, 1993, directed to a connector assembly for surface mounting to a planar electronic device, such as a printed circuit board. The present invention relates to edge or straddle mounting of the type of cable connector assembly thereof. Accordingly, for convenience, the co-pending application is incorporated by reference herein, in its entirety.

BACKGROUND OF THE INVENTION

The present invention relates to a low profile, cable connector receptacle assembly which is adapted to be edge mounted to an electronic planar device, such as a printed circuit board (PCB). More particularly, this invention is directed to the housing means by which the cable connector receptacle of said co-pending application may be edge mounted to a PCB, for example.

Coaxial cable receptacles for PCBs have been known for several years, where, such receptacles are typically surface mounted thereto. U.S. Pat. No. 3,915,535 represents such a device. For convenience, and by way of understanding and adoption herein, a coaxial cable is defined therein as an electrical cable containing two or more conductors each isolated from the others and running parallel to each other. A typical coaxial cable is one having a center conductor embedded in a dielectric and a woven or braided metallic shield surrounding the dielectric. An outer insulating jacket surrounds the shield. The center conductor carries the RF signal while the braided shield acts to shield the RF signal from interference; i.e., crosstalk, etc. In terminating the cable the shield goes to ground.

One of the disadvantages associated with surface mounting is due to a larger profile, at least by an amount equal to the thickness of the planar electronic device, and the consequence of requiring added space to accommodate the assembly. Edge or straddle mounting offers the advantage of a reduced profile, a feature that will become more apparent in the description which follows. However, before detailing the manner by which the present invention accomplishes its goal of providing a low profile connector assembly through edge mounting, it will be acknowledged that others have sought to edge mount, as evidenced by U.S. Pat. Nos. 5,190,461; 4,656,441; and 4,138,179.

SUMMARY OF THE INVENTION

The invention hereof is directed to a low profile coaxial cable connector assembly for edge mounting to a planar electronic device, such as a printed circuit board (PCB), where the PCB has electrical circuitry thereon for electrically interconnecting to the assembly. The assembly comprises a dielectric housing having at one end thereof a pair of spaced-apart, parallel walls adapted to straddle and be secured to the planar electronic device, and at the opposite end thereof a cavity for the reception of an electrically terminated coaxial cable. The other end of the assembly includes a grounding contact clip having a pair of parallelly extending spring metal arms for receiving the terminated coaxial cable, and a signal contact for mating with the terminated coaxial cable, where the grounding clip and signal contact include extensions therefrom for electrically interconnecting to the planar electronic device. By virtue of edge mounting the assembly, a significantly reduced profile is achieved.

DETAILED DESCRIPTION OF PREFERRED EMBODIMENT

The present invention relates to a low profile, coaxial cable, receptacle assembly for straddle mounting to the edge of a planar electronic device, such as a printed circuit board.

Figure 1:
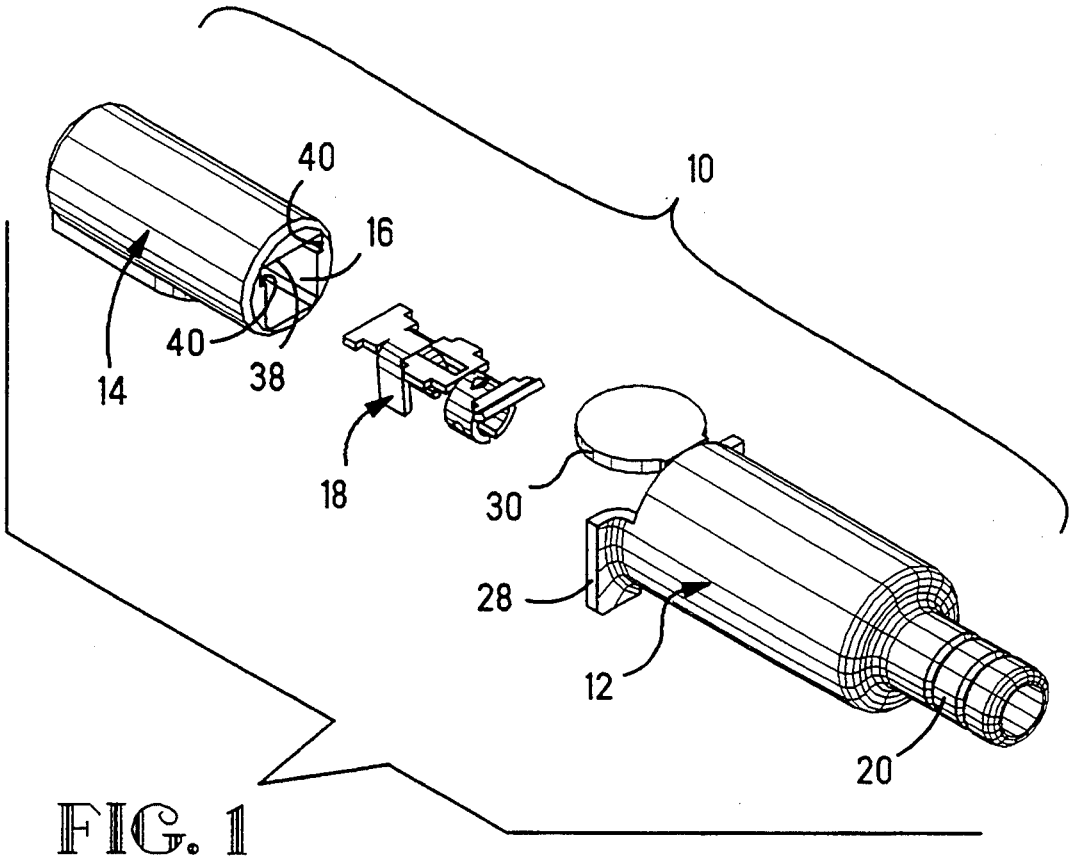
FIG. 1 is an exploded perspective view of the cable connector receptacle for electrically interconnecting to a straddle mounted assembly about the edge of a planar electronic device.

FIG. 1 illustrates the components of the coaxial cable receptacle. Specifically, the connector receptacle 10 consists of a stamped and formed, or drawn metal shell 12, a dielectric insert 14 having a contact receiving central cavity 16 therein, and a stamped and formed contact 18 for loading into said cavity. Although not illustrated, the shell 12 may include a cylindrical cable crimping ferrule to encircle the reduced shell section 20 and capture the metal grounding braid of a cable loaded into such reduced shell section.

Figure 3:
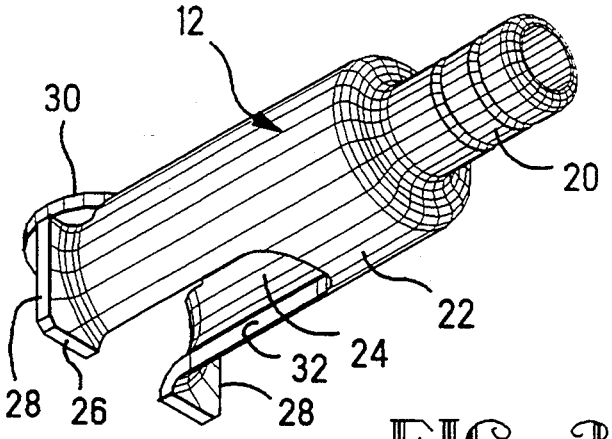
FIGS. 3 and 4 are front and rear perspective views, respectively, of the stamped and formed metal shell of the cable connector receptacle hereof.
Figure 4:
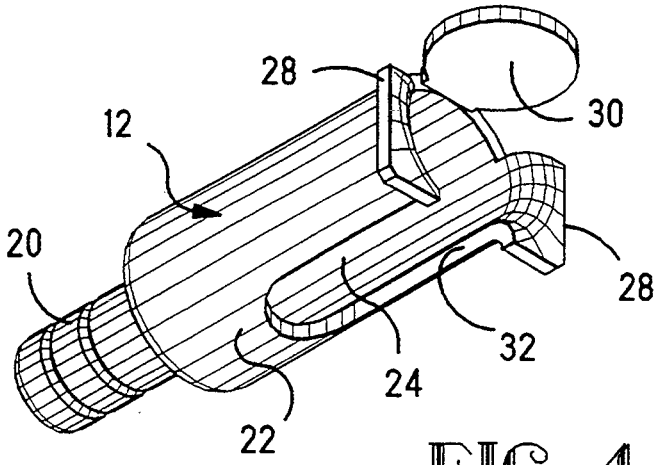

Turning now to further details of such components, the shell, as best illustrated in FIGS. 3 and 4, comprises an elongated, generally circularly body 22 having a central axial cavity 24 throughout, and a reduced section 20. The mating or insert loading end 26 features a pair of laterally extending wings or flanges 28 and a hinged flap 30. The bottom remote from the hinged flap 30, includes a cut out 32 to slidably receive the raised portion 34 of insert 14, when such insert is loaded into the shell 12, see FIG. 5. Also since the insert 14, when loaded therein, is fully contained within the shell 12, the hinged flap 30 may be pivoted to close the end 26.

Figure 5:
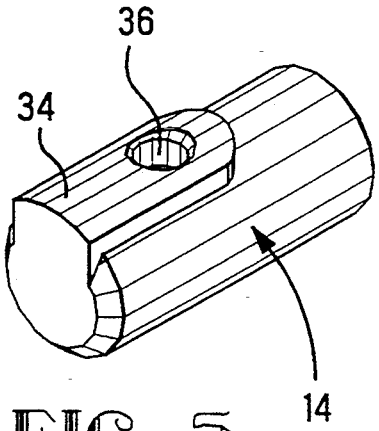
FIG. 5 is a perspective view of the dielectric insert for receiving the cable contact of FIG. 2.

The dielectric insert 14, upper and lower perspective views being illustrated in FIGS. 1 and 5, consists of a generally cylindrical body dimensioned to be received within the metal shell 12. The insert 14 includes a raised portion 34 along a section of the bottom thereof. The dimensions of the said portion are such as to allow seating thereof within a complementary cut out in the shell, as explained above. The raised portion 34 is provided with an opening 36 which communicates with the central cavity 16, as best seen in the sectional view of FIG. 6. The upper wall 38 of the cavity 16 includes a pair of channels 40 terminating in a lateral slot 42 midway into the insert, see FIG. 6. It will be apparent that as the contact 18 is loaded into the insert 14, the contact flanges 44, 46 seat within and ride along the respective channels 40 until the forward flange 44 comes to rest within the slot 42, thereby signalling a position of full loading.

Figure 2:
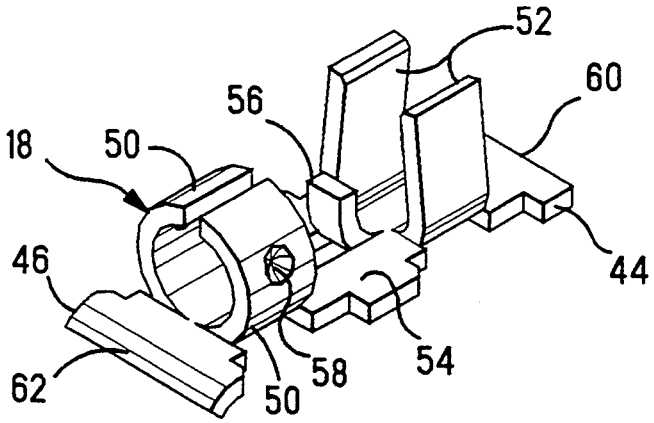
FIG. 2 is an enlarged perspective view of the cable contact for the cable connector receptacle according to this invention.

The final component, excluding the cable, for the connector receptacle, is the metal contact 18. FIG. 1 illustrates the metal contact 18 in a preloading position, whereas FIG. 2 shows the contact enlarged and turned 180° so as to reveal the constructive features thereof. The contact 18 consists of a stamped and formed metal member and includes a pair of cable engaging spring arms 50 and a pair of contact pin engaging arms 52, where the latter arms 52 are adapted to electrically engage and receive circular post, as later described.

Figure 6:
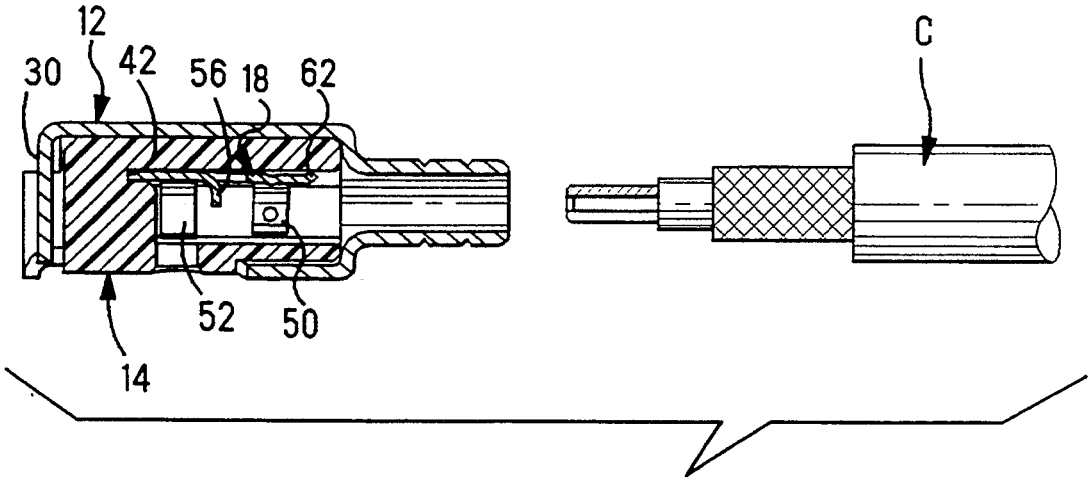
FIG. 6 is a sectional view of the cable connector receptacle of FIG. 1, with an aligned coaxial cable prior to loading thereof.

Struck from the base 54 is an upturned lance 56 which acts as a cable stop when securing, the cable "C" thereto, see FIG. 6. Further the spring arms 50 may be provided with plural bumps 58, such as by embossing, to better grip the insulation of the cable "C" disposed therebetween. Finally, the ends 60, 62 of the contact are provided with 'T' flanges 44, 46, respectively, to properly align the contact within the dielectric insert 14.

Figure 7:
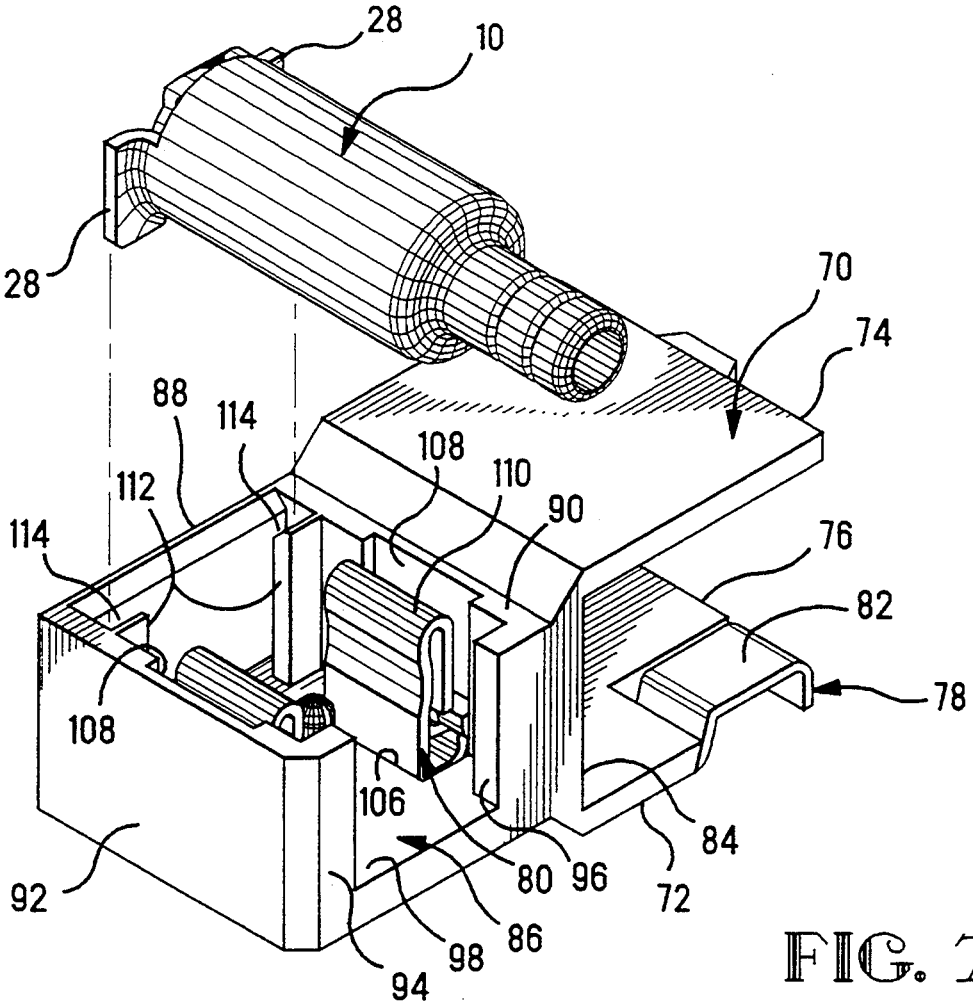
FIG. 7 is an exploded perspective view of the connector assembly according to this invention, where such assembly includes a straddle mounting housing for receipt of the assembled connector receptacle of FIG. 6.

The straddle mounting housing 70, for receiving connector receptacle of FIG. 6, is illustrated in FIG. 7. The housing comprises a pair of spaced-apart walls 72, 74 where the distance therebetween is such as to slidably receive a planar electronic device, such as a printed circuit board. Within the lower wall 72, one or two cut-outs 76 are provided to receive a grounding tab 78 which extends from the grounding clip 80, see FIGS. 8 and 9. It will be noted that the upturned end 82 of the grounding tab 78 is exposed to the space 84 whereby soldering of such end 82 to a grounding trace on the planar electronic device may be effected.

Extending oppositely from said spaced-apart walls 72, 74 is the receptacle receiving chamber 86. The chamber consists of an end wall 88, an inner wall 90 common with the PCB receiving portion, an outer wall 92, a front wall 94 having a reduced opening 96 to align and receive the connector receptacle, and a base 98. The base is characterized by a central opening 100 (FIG. 9) for receiving the post 102 of a signal contact 104, FIGS. 10 and 11, and a pair of aligned openings 106 for receiving the grounding clip 80 from below. The inner and outer walls 90, 92 also feature recessed portions 108, which allow for the lateral movement of the arms 110 of the grounding clip 80 when receiving the terminated shell 12.

Cooperating with the end wall 88 are a pair of slot defining ribs 112, whereby a pair of vertical slots 114 are provided to receive the outwardly extending wings 28 of the connector receptacle 10, when said receptacle is mated to said housing.

Figure 8:
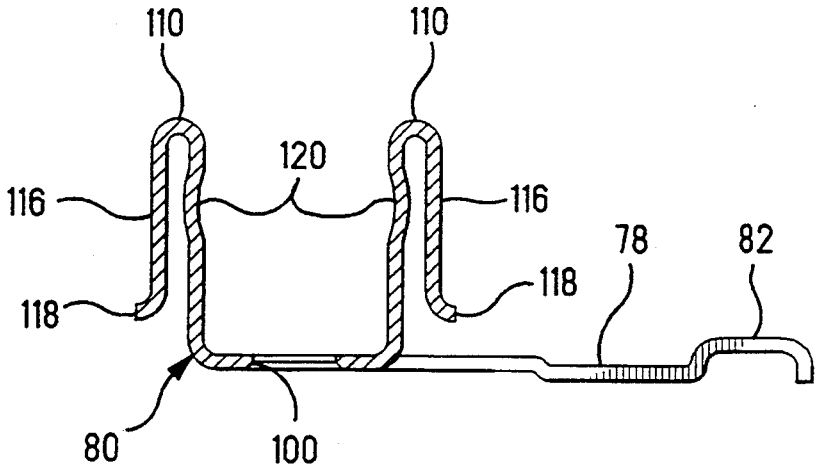
FIG. 8 is a sectional view of a grounding clip forming an element of the straddle mounting housing of FIG. 7.
Figure 9:
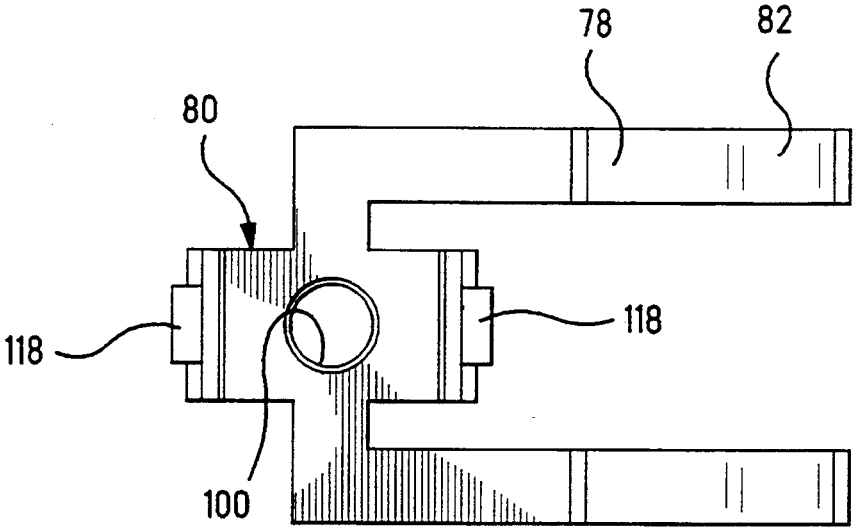
FIG. 9 is a top view of the grounding clip.
Figure 12:
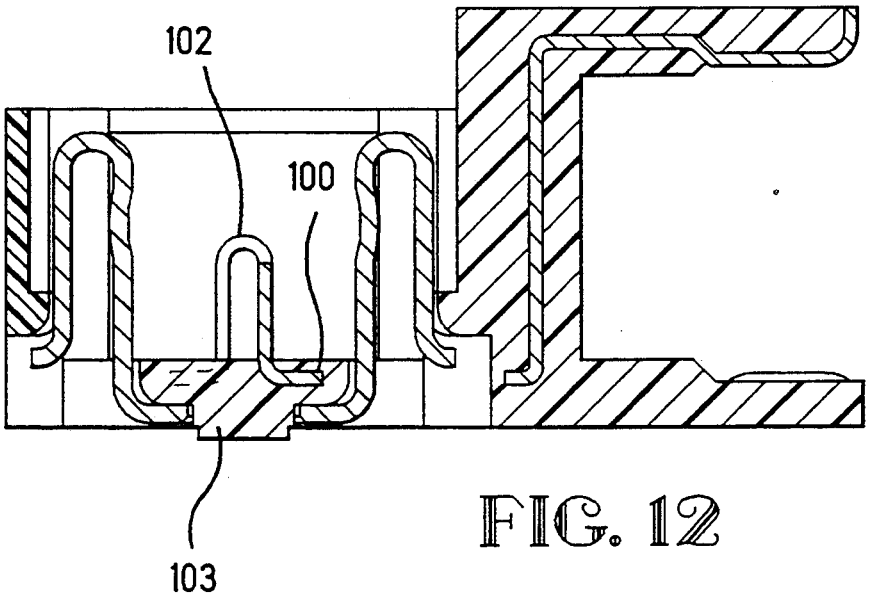
FIG. 12 is a sectional view of the straddle mounting housing showing its relationship to said signal contact.

The grounding contact clip 80, illustrated in FIGS. 8 and 9, is an electrically conductive, spring metal stamped and formed from a metal blank. The contact clip 80 comprises of a pair of upstanding arms 110, where the ends 116 are reverse bent 180° ending in a pair of tabs 118. The base of the grounding contact clip 80 includes a central opening 100 to allow the downwardly extending post 103 (FIG. 12) to extend through central opening 100. After bottom loading or mounting the grounding contact clip 80, the post 103 is heat staked to hold such grounding contact clip tight to the housing 70. Finally, it will be observed that each arm 110 has been formed to provide opposing curved recesses 120 to facilitate seating therein of the metal shell 12 when mated together.

Extending laterally and rearwardly from the base, the grounding clip 80 includes a pair of grounding tabs 78 having solder ends 82, which, as noted above, are positioned to be soldered to grounding traces or pads on a planar electronic device received between the walls 72, 74.

Figure 10:
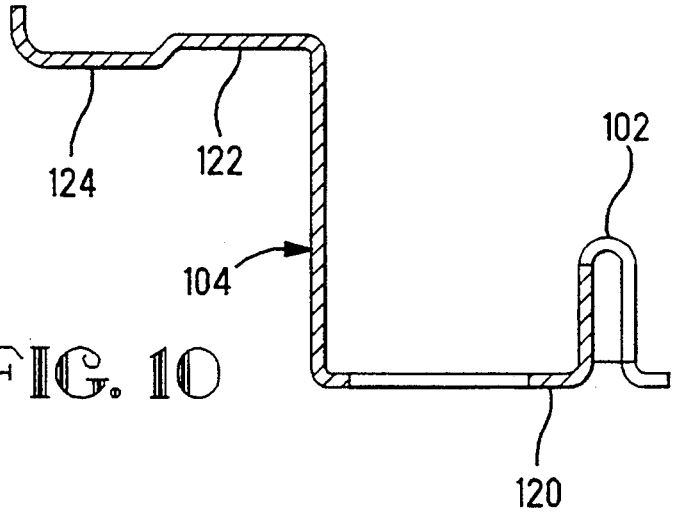
FIG. 10 is a sectional view of the signal contact adapted to be boy, tom mounted to the housing hereof.
Figure 11:
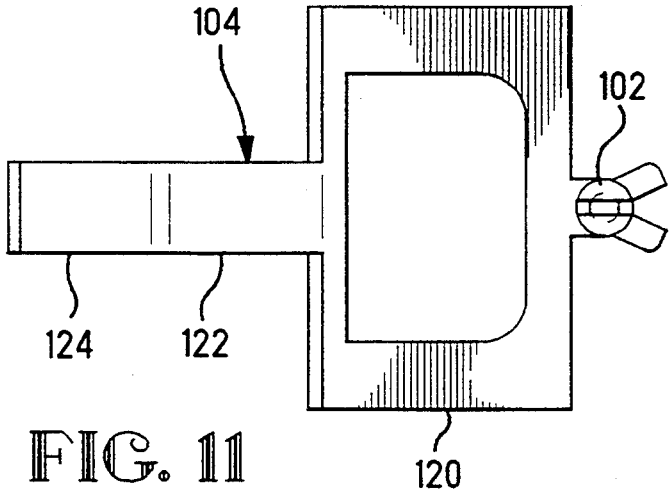
FIG. 11 is a top view of the signal contact of FIG. 10.

The signal contact clip 104, illustrated in FIGS. 10 and 11, comprises an electrically conductive spring material stamped and formed from a metal blank. The clip 104, includes at one end thereof a generally circular contact post 102, a base 120, and a single upstanding signal tab 122, where such clip is preferably molded within the housing 70. The signal tab 122 includes a formed end 124 which is exposed to the space 84 to effect soldering thereof to a signal pad or trace along the surface of the planar electronic device to be slidably received within such space, thereby electrically interconnecting the device to the signal clip 104.

Figure 13:
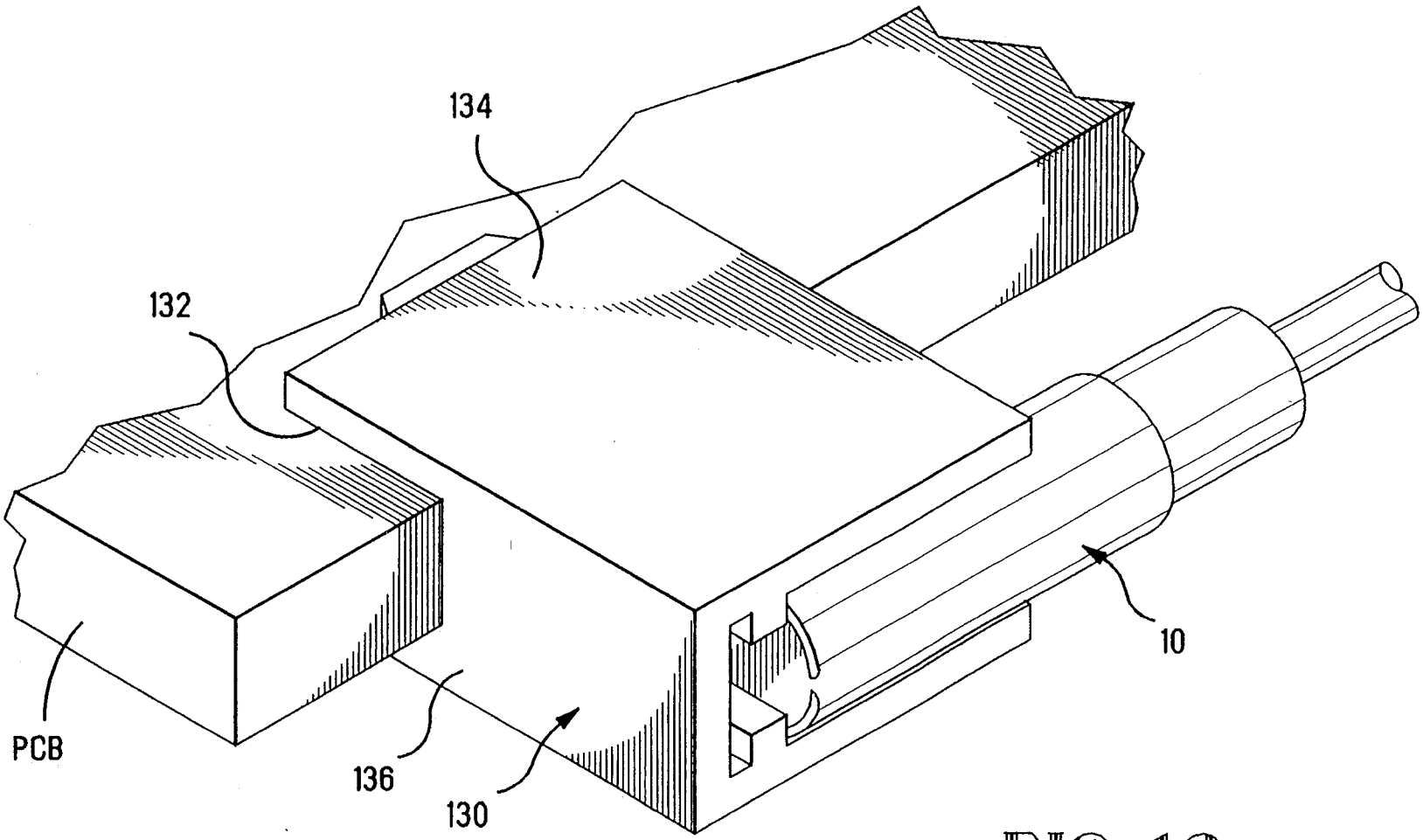
FIG. 13 is a partial perspective view of an alternate embodiment for a straddle mounting housing, where such housing illustrate a side entry cavity or slot for the cable connector receptacle according to this invention.
Figure 14:
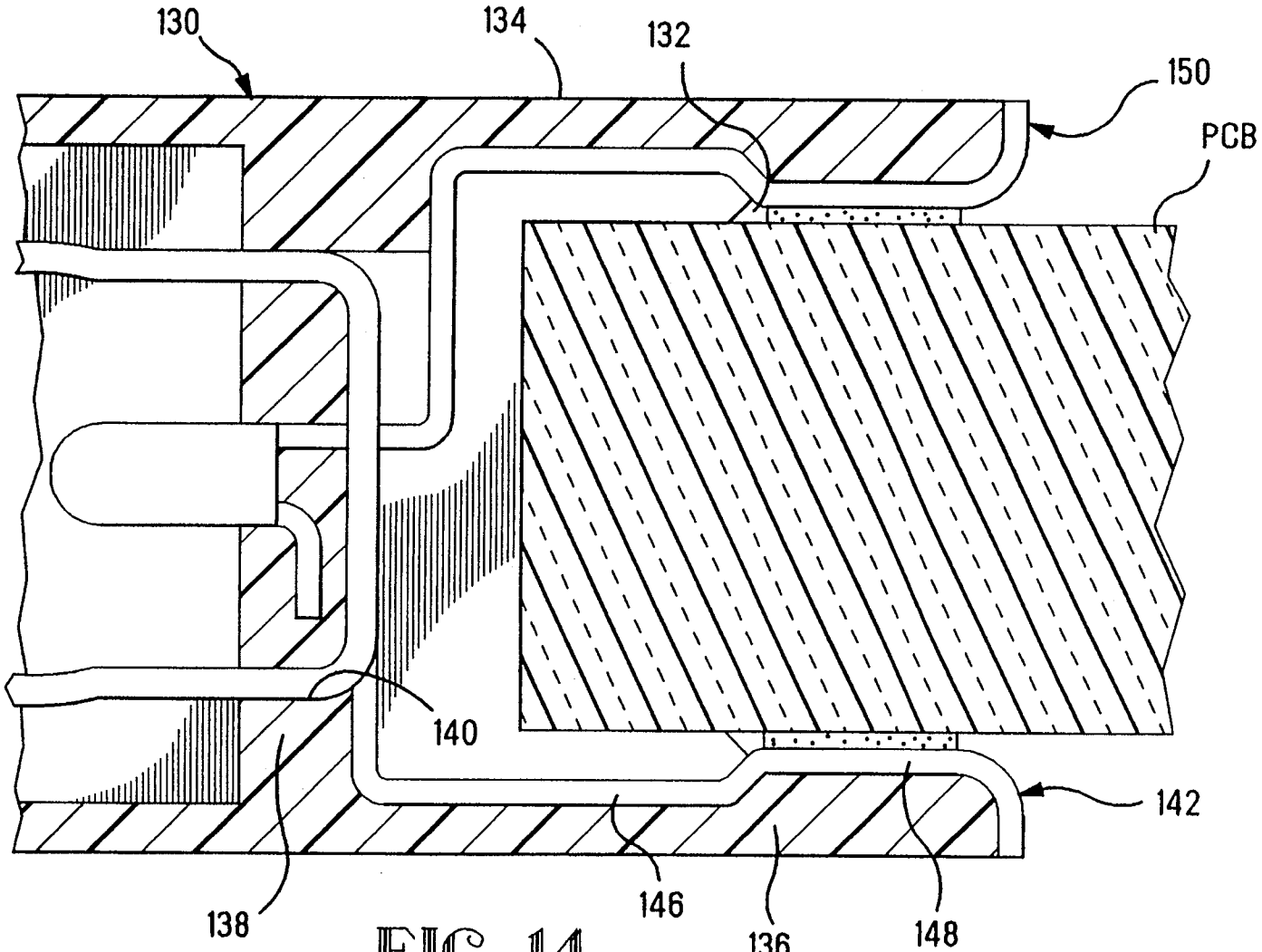
FIG. 14 is a sectional view of the straddle mounting housing for the embodiment of FIG. 13, further showing the mounting of a printed circuit board therein.

While FIG. 7 illustrates a top entry housing 70 for a low profile coaxial cable connector, FIGS. 13 and 14 represent an alternative embodiment, i.e. side entry for such connector. The alternate housing 130 comprises a PCB receiving cavity 132 defined by an upper wall 134, a base 136 and an intermediate common wall 138 with the grounding clip receiving cavity 140. Like the housing embodiment of FIG. 7, the assembly includes a grounding clip 142 having an arm 144 recessed 146 within the base 136, and an end portion 148 exposed for contact, such as by soldering to complementary grounding tabs or traces, not shown, on a PCB inserted into the cavity 140 between the upper wall 134 and base 136. Additionally, a signal contact clip 150, typically insert molded within the housing 130, may be provided for electrical contact to complementary signal traces on the PCB.

It will be further noted in FIG. 13 that the housing 130 may be lowered relative to the PCB as a way to further reduce the projection of the connector assembly above the PCB. That is, the thickness of the upper wall 134 is less than the thickness of the base 136.

I claim:

1. A low profile coaxial cable connector assembly for edge mounting to a planar electronic device, such as a printed circuit board, having electrical circuitry thereon for electrically interconnecting to said assembly, said assembly comprising a dielectric housing having at one end thereof a pair of spaced apart, parallel walls adapted to straddle and be secured to said planar electronic device, and at the opposite end thereof a cavity for the reception of an electrically terminated coaxial cable, where said other end includes a grounding contact clip having a pair of spring metal arms extending parallel to one another for receiving said terminated coaxial cable, and a signal contact for mating with said terminated coaxial cable, where said grounding clip and said signal contact include extensions therefrom for electrically interconnecting to said planar electronic device.

2. The low profile coaxial cable connector according to claim 1 wherein said spaced apart walls are oriented perpendicular to said planar electronic device to allow for top loading of said coaxial cable connector therein.

3. The low profile coaxial cable connector according to claim 1 wherein said spaced apart walls are oriented parallel to said planar electronic device to allow for side loading of said coaxial cable connector therein.

4. The low profile coaxial cable connector assembly according to claim 1, wherein said terminated coaxial cable is arranged linearly in a plane parallel to said planar electronic device.

5. The low profile coaxial cable connector assembly according to claim 1, wherein said one end includes an end wall having a pair of opposing slots.

6. The low profile coaxial cable connector according to claim 5, wherein said terminated coaxial cable is terminated within an essentially circular metal shell, where the shell at one end thereof includes a pair of laterally extending aligning wings adapted to engage said slots.

7. The low profile coaxial cable connector assembly according to claim 1, wherein said grounding contact clip is bottom loaded within said housing and includes an extension therefrom, where said extension is recessed within one of said spaced-apart, parallel walls and includes an end portion thereof in communication with the spaced between said parallel walls.

8. The low profile coaxial cable connector assembly according to claim 7, including a signal contact pin exposed between said spaced-apart parallel walls, said signal contact pin having an extension therefrom insert molded within the second of said spaced-apart parallel walls, where said extension includes an end portion thereof in communication with the space between said parallel walls.

* * * * *